US006869369B2

(12) United States Patent
Fairweather

(10) Patent No.: US 6,869,369 B2
(45) Date of Patent: Mar. 22, 2005

(54) PARTICULATE MATTER PROPULSION APPARATUS

(76) Inventor: Andrew Peter Fairweather, 19 Daglish Street, Wembley, Western Australia, 6014 (AU)

( * ) Notice: Subject to any disclaimer, the term of this patent is extended or adjusted under 35 U.S.C. 154(b) by 13 days.

(21) Appl. No.: 10/416,650

(22) PCT Filed: Nov. 29, 2001

(86) PCT No.: PCT/AU01/01550

§ 371 (c)(1),
(2), (4) Date: May 14, 2003

(87) PCT Pub. No.: WO02/43966

PCT Pub. Date: Jun. 6, 2002

(65) Prior Publication Data

US 2004/0198503 A1 Oct. 7, 2004

(30) Foreign Application Priority Data

Nov. 30, 2000 (AU) ..... PR 1762
Aug. 15, 2001 (AU) ..... PR 7026

(51) Int. Cl.[7] ..... A63H 37/00
(52) U.S. Cl. ..... 472/52; 446/148; 446/475
(58) Field of Search ..... 472/51, 52; 446/147, 446/148, 475, 483; 40/124.1, 124.06, 124.11; 206/461, 462, 469

(56) References Cited

U.S. PATENT DOCUMENTS 2,005,859 A * 6/1935 Hoke ..... 40/607.14
3,235,988 A * 2/1966 Paige ..... 40/124.08
4,440,298 A * 4/1984 Knight ..... 206/216
4,787,160 A * 11/1988 Balsamo ..... 40/124.12
5,199,745 A * 4/1993 Balsamo ..... 283/117
5,263,890 A * 11/1993 Dent, IV ..... 446/475
5,771,614 A * 6/1998 Dawson ..... 40/124.06

FOREIGN PATENT DOCUMENTS

FR 2699860 A1 * 7/1994 ..... B42D/15/04
FR 2790423 A1 * 9/2000 ..... B42D/15/08
GB 2336808 A * 11/1999 ..... B42D/15/04

* cited by examiner

*Primary Examiner*—K. T. Nguyen
(74) *Attorney, Agent, or Firm*—Kohn & Associates, PLLC

(57) ABSTRACT

A particulate matter propulsion apparatus (10) for propelling confetti (94) or similar from a greeting card (12). The propulsion device includes a particulate matter receptacle (14) attached to a supporting means (16), the supporting means (16) being store energy such that when the card (12) is opened the particulate matter (94) is propelled from the card (12).

14 Claims, 4 Drawing Sheets

PARTICULATE MATTER PROPULSION APPARATUS

CROSS-REFERENCE TO RELATED APPLICATIONS

This patent application is a National Phase claiming the benefit of priority of PCT/AU01/01550, filed 29 Nov. 2001, which claims the benefit of priority of Australian Provisional Patent Application Number PR 1762, filed 30 Nov. 2000, and Australian Provisional Patent Application Number PR7026, filed 15 Aug. 2001, all of which are incorporated herein by reference.

FIELD OF THE INVENTION

A common expression of celebration is the throwing in the air of particulate matter such as paper confetti or rice. It is considered desirable to incorporate this form of expression into a greeting card.

A known type of greeting card incorporates a tearable package of confetti within a closed card. The action of opening the greeting card causes the package to tear, and the confetti to be released. Such a card, however, includes no mechanism to actually propel the confetti into the air.

Another known type of greeting card includes an elastic member coiled within the card, and an envelope containing particulate matter connected to the elastic member. The action of opening this greeting card causes the elastic member to unwind, thus spinning the envelope of particulate material and causing the material to be flung outwards by the action of centrifugal force. This mechanism can cause the particulate material to be flung in all directions, not merely upwards.

The present invention attempts to overcome at least in part some of the aforementioned disadvantages of previous particulate matter propulsion apparatuses for greeting cards.

SUMMARY OF THE INVENTION

In accordance with one aspect of the present invention there is provided a particulate matter propulsion apparatus for use in relation to a greeting card, the apparatus comprising a particulate matter receptacle attached to a supporting means, the apparatus characterised in that, in use, the supporting means urges the particulate matter receptacle away from the greeting card thus causing particulate matter within the particulate matter receptacle to be propelled into the air.

BRIEF DESCRIPTION OF THE DRAWINGS

The present invention will now be described, by way of example, with reference to the accompanying drawings, in which.

DESCRIPTION OF THE INVENTION

Figure 1:
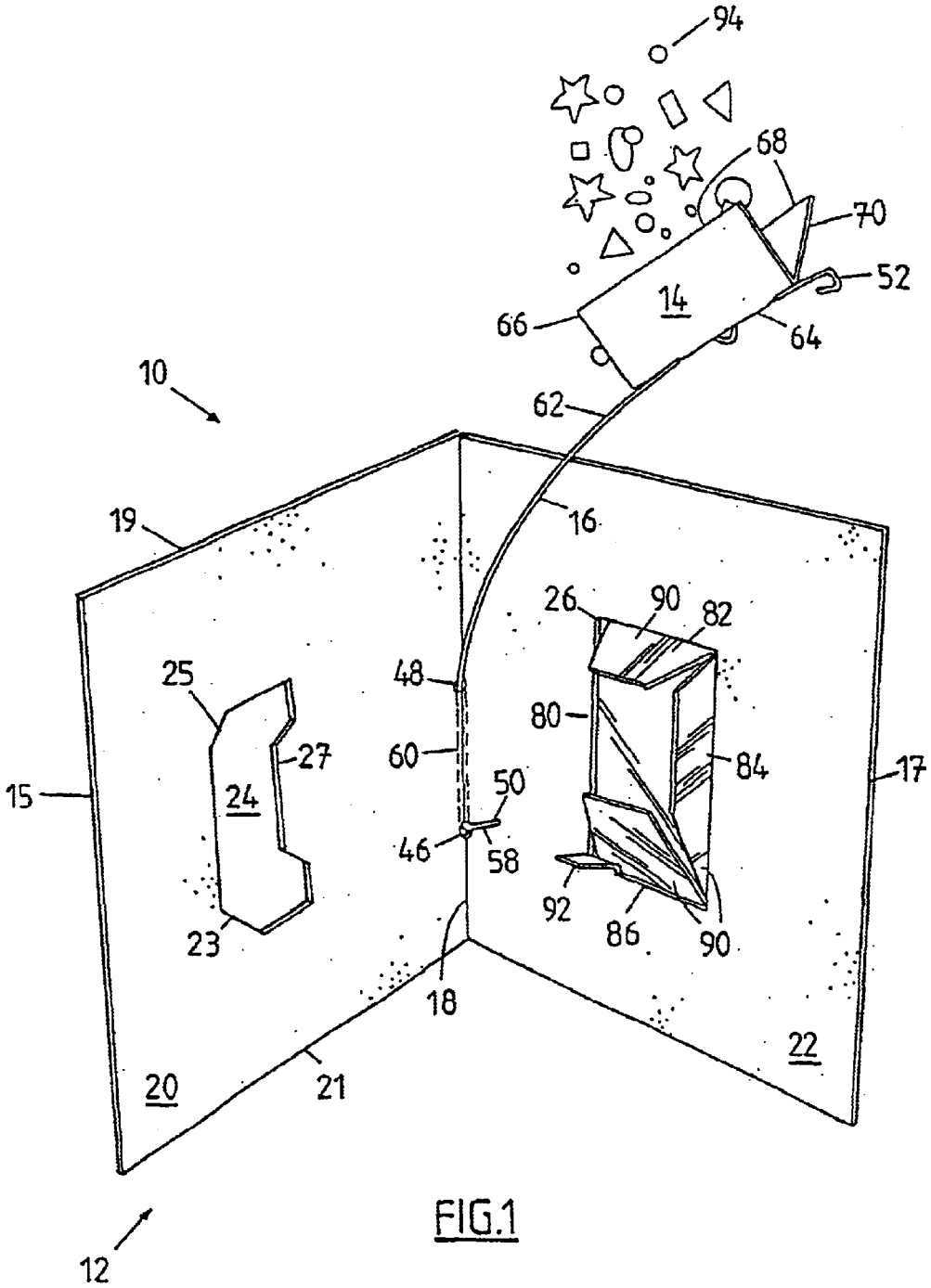
FIG. 1 is a view of a particulate matter propulsion apparatus in accordance with the present invention in a first position.

Referring to the Figures, there is shown a particulate matter propulsion apparatus 10 including a card 12, and a particulate matter receptacle 14 having a supporting means 16. In the embodiment of the Figures the card 12 is arranged to be inserted within a greeting card, however it will be appreciated that in an alternative embodiment the card 12 could in fact be a greeting card.

The card 12 is substantially rectangular in shape, and is composed of a suitable material, for instance cardboard. The card 12 has a first edge 15, a second edge 17 opposite the first edge 15, a top edge 19 and a bottom edge 21. The card 12 includes a fold 18 substantially in the centre of the card 12, thus dividing the card 12 into a first side 20 extending from the first edge 15 to the fold 18 and a second side 22 extending from the fold 18 to the second edge 17.

The card 12 includes a front window 24 disposed approximately centrally of the first side 20 and a rear window 26 disposed approximately centrally of the second side 22. The rear window 26 is substantially rectangular. The front window 24 is substantially rectangular with chamfered outer corners 23, 25 on the corners closest to the first edge 15. The front window 24 is smaller than the rear window 26. The front window 24 has a tab 27 extending from an edge of the front window 24 adjacent the fold 18. The front and rear windows 24, 26 are arranged so that when the card is closed along the fold 18 the front window 24 is substantially coextensive with an inner portion of the rear window 26.

The fold 18 includes a first aperture 46 located approximately one third of the way between the bottom edge 21 and the top edge 19, and a second aperture 48 located approximately two thirds of the way between the bottom edge 21 and the top edge 19. The supporting means 16 is composed of a partially resilient material, for instance a metal such as spring steel. The supporting means 16 has a first end 50 and a second end 52. The supporting means 16 is arranged to pass through the first and second apertures 46, 48 such that the first end 50 is located adjacent the first aperture 46 on the inner side of the card 12. The supporting means 16 thus has a first portion 58 extending from the first end 50 to the first aperture 46, a second portion 60 extending from the first aperture 46 to the second aperture 48 and a third portion 62 extending from the second aperture 48 to the second end 52. The first and third portions 58, 62 are thus positioned inside the card 12 and the second portion 60 outside the card 12. The fist portion 58 is bent at the first aperture 46 so as to hold the supporting means 16 in position in the fold 18. The supporting means is bent around at the second end 52 so as to prevent a sharp point from being oriented outwards.

The particulate matter receptacle 14 is arranged adjacent the second end 52 of the supporting means 16. The particulate matter receptacle 14 comprises a substantially rectangular portion, with a central fold 64. Folding the rectangular portion along the central fold 64 forms an envelope open on three sides, a first side 66 adjacent the fold 64 and remote, in use, from the second end 52 of the supporting means 16, a second side 68 opposite the central fold 64 and a third side 70 opposite the first side 66 and adjacent, in use, the second end 52 of the supporting member 16. When folded, the particulate matter receptacle 14 is approximately the same size as the rear window 26. The particulate matter receptacle 14 is attached to the supporting means 16 by suitable means such that the supporting means 16 is arranged within the central fold 64 of the particulate matter receptacle 14. The supporting means 16 may be kinked at the fold 64 in order to attach to the particulate matter receptacle 14. The particulate matter receptacle 14 may be constructed from transparent material to allow a user to view particulate matter through the front window 24 of the card 12.

The rear window 26 of the card 12 has first, second, third and fourth sides 80, 82, 84 and 86 respectively, numbered in a clockwise fashion beginning with the first side adjacent the fold 18 of the card 12. The second, third and fourth sides 82, 84, 86 include catches 90 arranged, in use, to receive the first, second and third sides 66, 68 and 70 of the particulate matter receptacle 14. A second tab 92 is provided attached to the fourth side 86 adjacent the first side 80. The second tab 92 is in front of the catch 90, so that the catch 90 is between the rear window 26 and the second tab 92. The operation of the particulate matter propulsion apparatus will now be described with reference to the drawings.

The particulate matter propulsion apparatus is shown in FIG. 1 in an initial open position, whereby the second end 52 of the supporting means 16 is free, and the particulate matter receptacle 14 is ready for the insertion of confetti 94.

Figure 2:
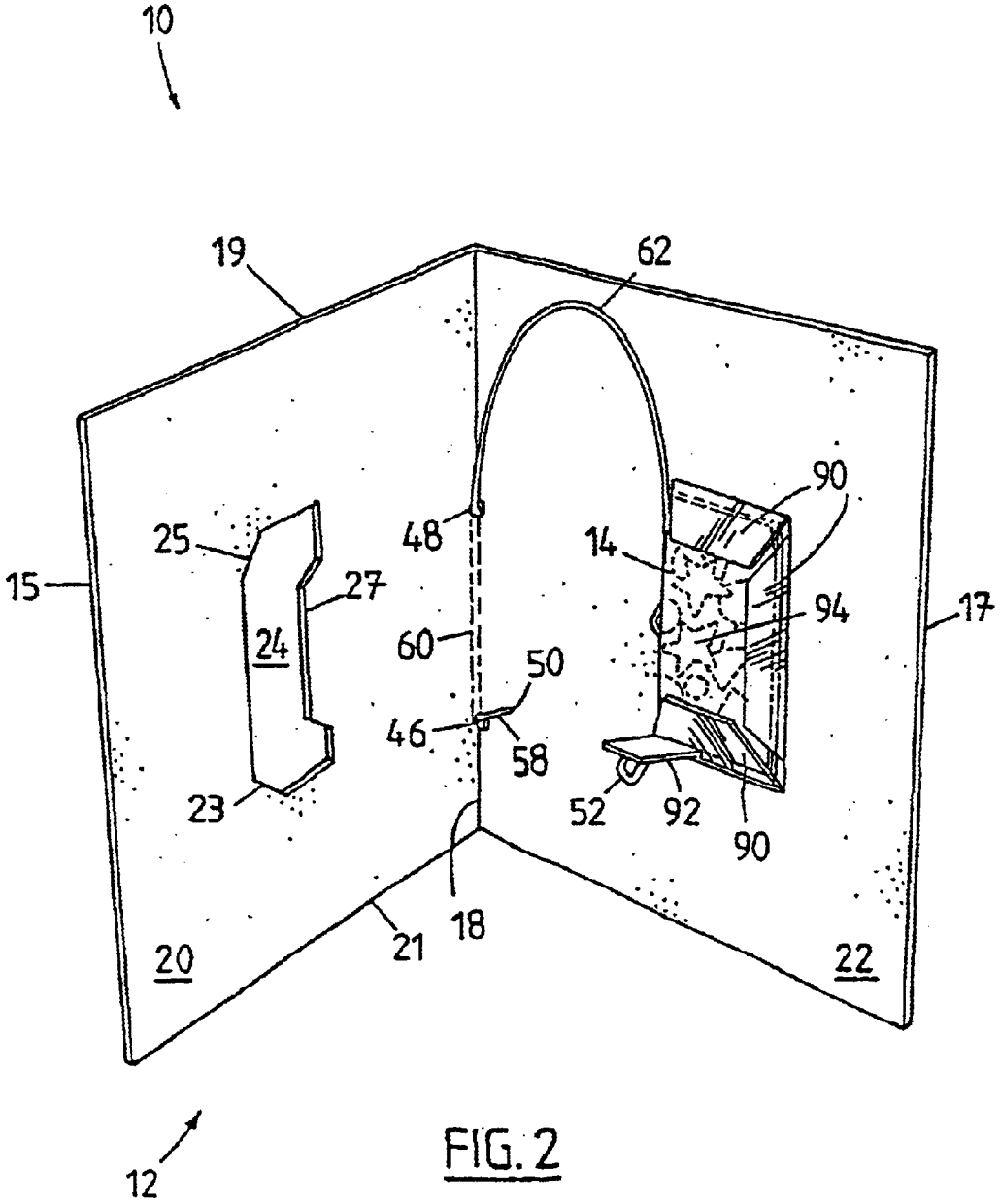
FIG. 2 is a view of the particulate matter propulsion apparatus of FIG. 1 in a second position.

The third portion 62 of the supporting means 16 is then bent, so as to store potential energy. This is shown in FIG. 2. The open edges of the particulate matter receptacle 14, that is first, second and third edges 66, 68 and 70 are held within the catches 90 of the rear window 26 and thus the particulate matter 94 is restrained within the particulate matter receptacle 14.

Figure 3:
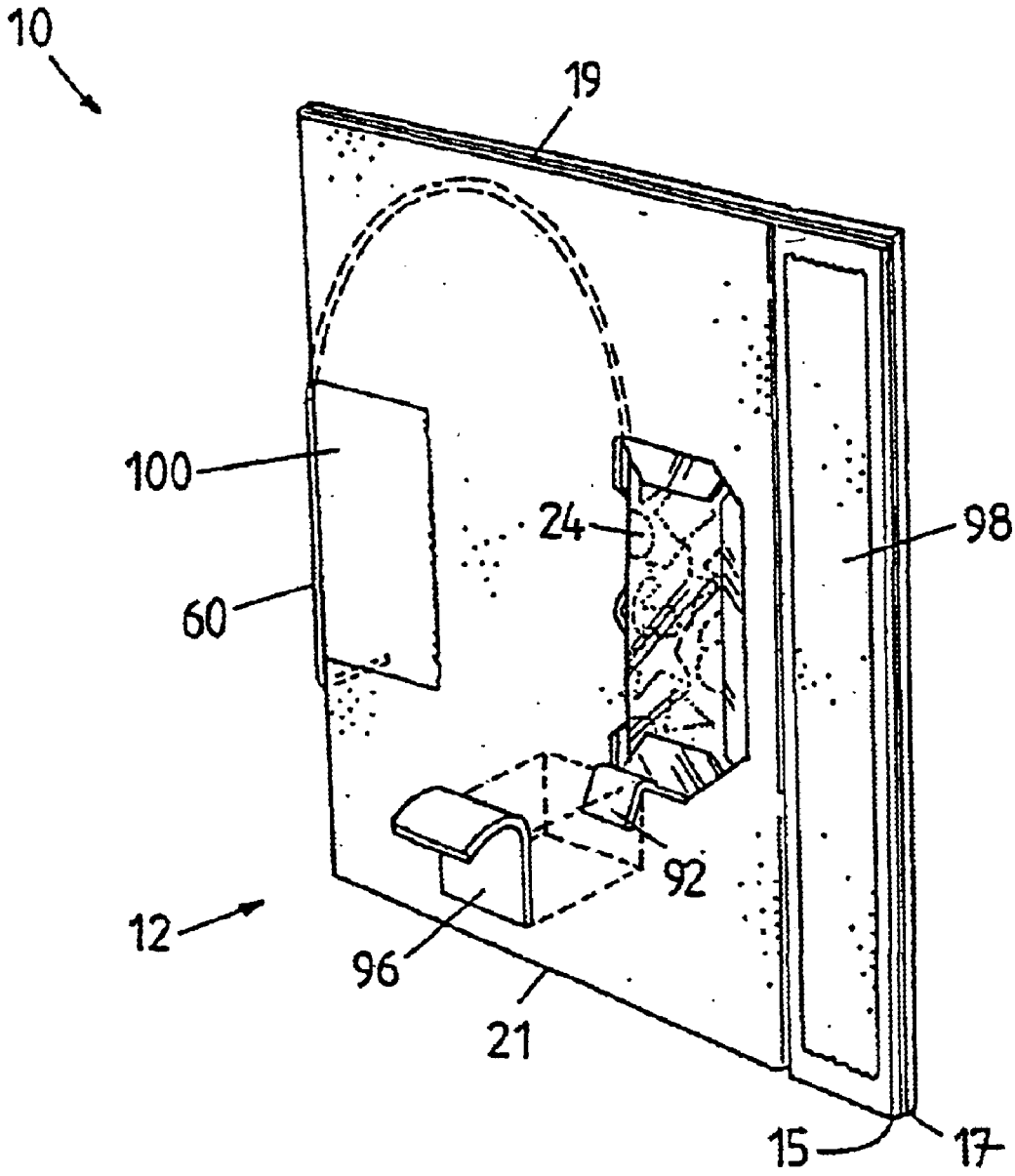
FIG. 3 is a view of the particulate matter propulsion apparatus of FIG. 1 in a third position.

The card 12 is then folded along the fold 18 to the closed position shown in FIG. 3. The first tab 27 is passed between the particulate matter receptacle 14 and the rear window 26. The second tab 92 is passed through the front window 24, and may be secured on the outside of card by means of adhesive tape 96. The catches 90 are held closed about the particulate matter receptacle 14 by the chamfered edges 23, 25 of the front window 24. The card 12 may be safely transported in this position. The card 12 may be primed by removal of the adhesive tape 96.

Figure 4:
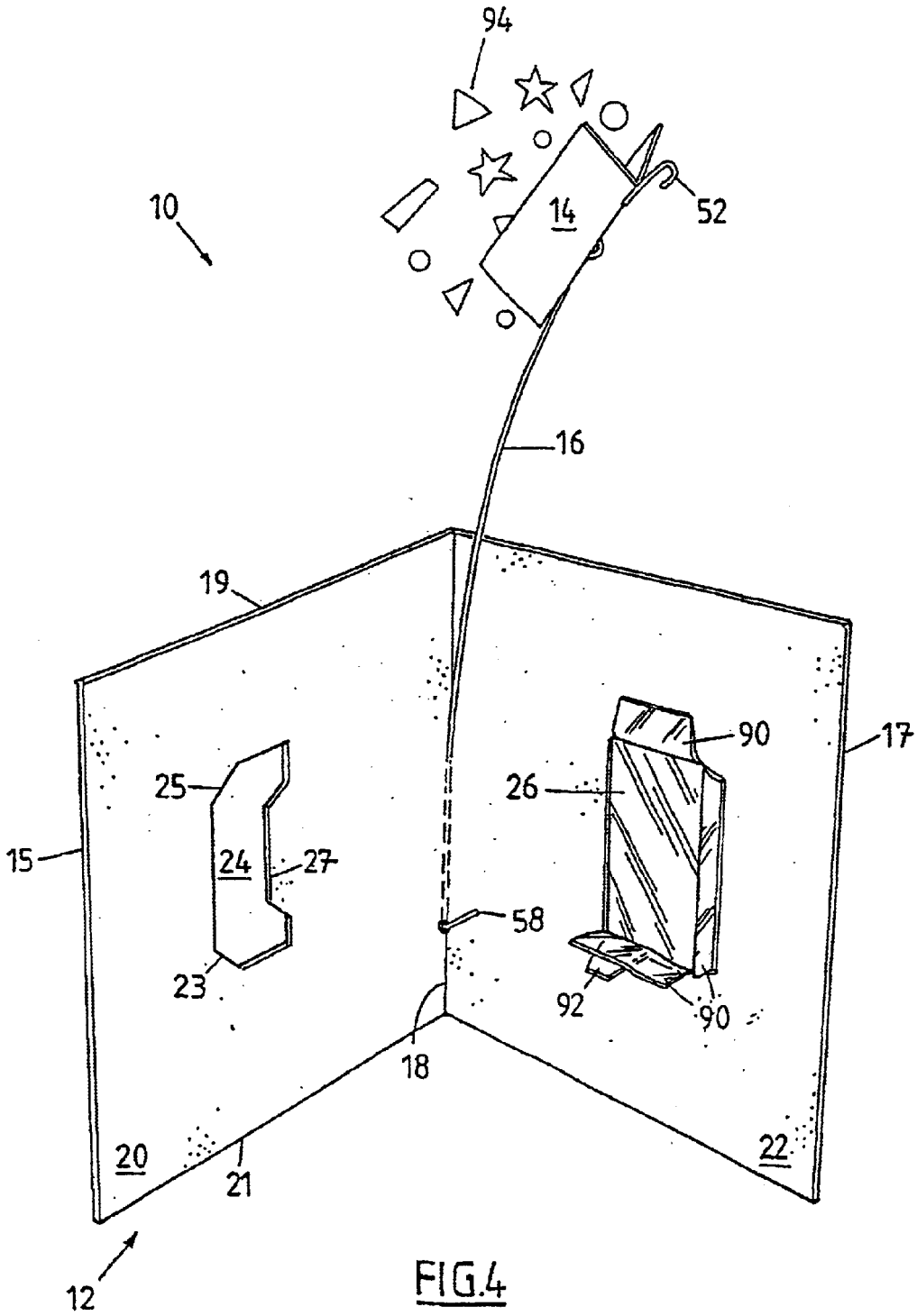
FIG. 4 is a view of the particulate matter propulsion apparatus of FIG. 1 in a fourth position.

When the card has thus been primed, opening of the card will cause the catches 90 to be released from the front window 24. The first tab 27 will pull the particulate matter receptacle 14 away from the catches 90. At the same time the second tab 92 will release the supporting means 16. This release will allow the potential energy in the third portion 62 of the supporting means 16 to be released, and the supporting means 16 will spring back to its initial position. This will cause the confetti 94 to be propelled into the air, as shown in FIG. 4.

The card 12 may be provided with adhesive strips 98 on the outer surface to enable it to be located within a greeting card. The card 12 may also be provided with a restraining portion 100 on the outside of the fold 18 to hold the second portion 60 of the supporting means 16 in position.

Modifications and variations as would be apparent to a skilled addressee are deemed to be within the scope of the present invention.

What is claimed is:

1. A particulate matter propulsion apparatus for use in relation to a greeting card, the greeting card having a first side and a second side separated by a fold, the greeting card having a top edge and a bottom edge, the particulate matter propulsion apparatus having an open position when the fold is open and a closed position when the fold is closed, the apparatus comprising a particulate matter receptacle connected to a greeting card solely by a supporting means, the supporting means having a first end adjacent the greeting card and a second end free to move relative to the greeting card, the particulate matter receptacle being attached to the supporting means adjacent the second end thereof, the apparatus characterized in that the supporting means is arranged to be bent so as to store potential energy and hold the particulate matter receptacle within the greeting card when the apparatus is in the closed position, and whereby opening of the greeting card causes the supporting means to urge the particulate matter receptacle away from the fold thus causing particulate matter within the particulate matter receptacle to be propelled into the air upwardly past the top edge of the card in a direction substantially aligned with the direction of movement of the particulate matter receptacle.

2. The particulate matter propulsion apparatus as claimed in claim 1, characterized in that the first end of the supporting means is located adjacent the fold of the card.

3. The particulate matter propulsion apparatus as claimed in claim 1, characterized in that there is a first aperture and a second aperture in the fold of the card of the particulate matter propulsion apparatus and the supporting means passes through the first and second apertures such that the supporting means has a first portion adjacent the first end, the first portion being on an inner side of the card, a second portion on an outer side of the card and a third portion adjacent the second end of the supporting means, the third portion being on an inner side of the card.

4. The particulate matter propulsion apparatus as claimed in claim 1, characterized in that the particulate matter propulsion apparatus includes catches that are arranged to hold the particulate matter receptacle in a closed position.

5. The particulate matter propulsion apparatus as claimed in claim 4, characterized in that the catches are located on the second side of the card.

6. The particulate matter propulsion apparatus as claimed in claim 5, characterized in that the catches are restrained from releasing the particulate matter receptacle by the first side of the card when the particulate matter propulsion apparatus is in the closed position.

7. The particulate matter propulsion apparatus as claimed in claim 6, characterized in that a first tab extends from the first side of the card, the first tab being arranged to be located between the particulate matter receptacle and the second side of the card when the particulate matter propulsion apparatus is in the closed position.

8. The particulate matter propulsion apparatus as claimed in claim 7, characterized in that a second tab extends from the second side of the card and arranged to pass through a window in the first side of the card, such that when the second tab is secured to an outer portion of the first side of the card the particulate matter propulsion apparatus is restrained from opening.

9. The particulate matter propulsion apparatus as claimed in claim 1, characterized in that the supporting means is comprised of a resilient material.

10. The particulate matter propulsion apparatus as claimed in claim 9, characterized in that said resilient material is spring steel.

11. The particulate matter propulsion apparatus as claimed in claim 9, characterized in that the particulate matter propulsion apparatus has attaching means for attachment to the greeting card.

12. The particulate matter propulsion apparatus as claimed in claim 1, characterized in that the particulate matter is confetti.

13. A particulate matter propulsion apparatus for use in relation to a greeting card, the apparatus being contained within an insert card having a first side and a second side separated by a fold, the insert card having a top edge and a bottom edge, the particulate matter propulsion apparatus having an open position when the fold is open and a closed position when the fold is closed, the apparatus comprising a particulate matter receptacle connected to the insert card solely by a supporting means, the supporting means having a first end adjacent the insert card and a second end free to move relative to the insert card, the particulate matter receptacle being attached to the supporting means adjacent the second end thereof, the apparatus characterized in that the supporting means may be bent so as to store potential energy and hold the particulate matter receptacle within the greeting card when the apparatus is in the closed position, and whereby opening of the insert card causes the supporting means to urge the particulate matter receptacle away from the fold thus causing particulate matter within the particle matter receptacle to be propelled into the air upwardly past the top edge of the card in a direction substantially aligned with the direction of movement of the particulate matter receptacle.

14. A particulate matter propulsion apparatus for use in relation to a greeting card, the apparatus being contained within a card, the card being a greeting card or an insert for a greeting card, the card having a first side and a second side separated by a fold, the particulate matter propulsion apparatus having an open position when the fold is open and a closed position when the fold is closed, the fold having a first aperture and a second aperture therein, the apparatus comprising a particulate matter receptacle connected to the card solely by a supporting means, the supporting means having a first end adjacent the card and a second end free to move relative to the card, the supporting means passing through the first and second apertures such that the supporting means has a first portion adjacent the first end, the first portion being on an inner side of the card, a second portion on an outer side of the card and a third portion adjacent the second end of the supporting means, the third portion being on an inner side of the card, the particulate matter receptacle being attached to the supporting means adjacent the second end thereof, the apparatus characterized in that the supporting means urges the particulate matter receptacle away from the card thus causing particulate matter within the receptacle to be propelled into the air.

* * * * *